US008866411B2

(12) United States Patent
Zhang et al.

(10) Patent No.: US 8,866,411 B2
(45) Date of Patent: Oct. 21, 2014

(54) CURRENT CONTROL DISCHARGE LAMP SYSTEM AND METHOD FOR CONTROLLING CURRENT OF DISCHARGE LAMP

(75) Inventors: Qi Zhang, Shanghai (CN); Wei-Qiang Zhang, Shanghai (CN); Jian-Ping Ying, Shanghai (CN)

(73) Assignee: Delta Electronics (Shanghai) Co., Ltd., Shanghai (CN)

( * ) Notice: Subject to any disclaimer, the term of this patent is extended or adjusted under 35 U.S.C. 154(b) by 523 days.

(21) Appl. No.: 13/241,318

(22) Filed: Sep. 23, 2011

(65) Prior Publication Data

US 2013/0026938 A1 Jan. 31, 2013

(30) Foreign Application Priority Data

Jul. 28, 2011 (CN) ..... 2011 1 0213985

(51) Int. Cl.
*G05F 1/00* (2006.01)

(52) U.S. Cl.
USPC ..... 315/307; 315/291; 315/247; 315/312; 315/224

(58) Field of Classification Search
USPC ..... 315/247, 224, 225, 209 R, 246, 185 S, 315/291, 307–312
See application file for complete search history.

(56) References Cited

U.S. PATENT DOCUMENTS

2009/0237625 A1* 9/2009 Yamauchi ..... 353/85
2013/0038234 A1* 2/2013 Van Der Veen et al. ..... 315/224

FOREIGN PATENT DOCUMENTS

| | | | |
|---|---|---|---|
| CN | 1291418 | A | 4/2001 |
| CN | 1685737 | A | 10/2005 |
| JP | 2005-196011 | | 7/2005 |
| JP | 2005-353488 | | 12/2005 |
| JP | 2008-145507 | | 6/2008 |
| JP | 2009-288349 | | 12/2009 |
| TW | 569648 | | 1/2004 |
| TW | I256274 | | 6/2006 |
| TW | I277370 | | 3/2007 |

* cited by examiner

*Primary Examiner* — Tuyet Thi Vo
(74) *Attorney, Agent, or Firm* — CKC & Partners Co., Ltd.

(57) ABSTRACT

A discharge lamp system includes a discharge lamp, a power source, a converter, a lamp state signal detection module and a controller. The power source provides a DC power. The converter converts the DC power into a current required by the discharge lamp. The lamp state signal detection module receives a lamp state signal and outputs a lamp state detection signal. The controller processes the lamp state detection signal and a given synchronization signal to generate an average lamp current signal and a pulse current signal, and then processes the average lamp current signal and the pulse current signal to generate a control signal. The controller performs current control of the discharge lamp through the converter according to the control signal. Furthermore, a method for controlling a discharge lamp is also disclosed herein.

16 Claims, 12 Drawing Sheets

CURRENT CONTROL DISCHARGE LAMP SYSTEM AND METHOD FOR CONTROLLING CURRENT OF DISCHARGE LAMP

RELATED APPLICATIONS

This application claims priority to Chinese Patent Application Serial Number 201110213985.2, filed Jul. 28, 2011, which is herein incorporated by reference.

BACKGROUND

1. Technical Field

The present disclosure relates to a discharge lamp system. More particularly, the present disclosure relates to a discharge lamp system for projection and a method for controlling a discharge lamp.

2. Description of Related Art

In recent days, there have been a variety of projection apparatuses, such as Digital Light Processing (DLP) projection apparatus, LCD projection apparatus, Liquid Crystal on Silicon (LCOS) projection apparatus, etc., provided for different consumers. For a DLP projection apparatus, a discharge lamp is usually employed to generate the light for projection. In the DLP projection apparatus, a color filter (dynamic color filter) which is composed by a color wheel having three primary color segments, i.e., red (R), green (G) and blue (B), is used to filter the light from a light source, thus generating beams of three primary colors. A spatial light modulator is controlled synchronously and operated with the color filter to generate three primary color images so that color pictures can be shown. In the application that brightness is emphasized, a four-color dynamic color filter in which a white color (W) is added to the three primary colors R, G, B, is occasionally used to generate four-color images so that color pictures can be shown. Sometimes, more color segments are configured so that performance of color images can be enhanced.

However, for the four-color dynamic color filter, intrinsic properties of the color lights are different and requirements of brightness of the color lights are also different (e.g., one of the four colors has a different brightness from the others, or the brightness of a specific image area is different from that of the other image area), so intensity of light emitted by the discharge lamp is required to be different so that the current required by the discharge lamp has to be different as well. FIG. 1 is a diagram illustrating discharge lamp currents corresponding to the four color images generated by the four-color filter. As mentioned above, the current of the discharge lamp needs to be controlled so as to regulate the intensity of each color light, further achieving the purpose of projection.

SUMMARY

An aspect of the present invention is to provide a discharge lamp system which comprises a discharge lamp, a power supply device, a converter, a lamp state signal detection module and a controller. The power supply device is configured for providing a DC power. The converter is connected to the power supply device and the discharge lamp and configured for converting the DC power into a current required by the discharge lamp. The lamp state signal detection module is configured for receiving a lamp state signal and outputting a lamp state detection signal. The controller is connected to the lamp state signal detection module and configured for receiving the lamp state detection signal and a synchronization signal to generate an average lamp current signal and a pulse current signal, which corresponds to the lamp state detection signal and the synchronization signal, and for outputting a control signal which corresponds to the average lamp current signal and the pulse current signal to the converter. The converter performs current control of the discharge lamp according to the received control signal.

In accordance with one embodiment of the present invention, the controller further comprises a microprocessor and a control circuit. The microprocessor is configured for receiving the lamp state detection signal and the synchronization signal and generating a processing signal which corresponds to the current control of the discharge lamp. The control circuit is connected to the microprocessor and configured for receiving the processing signal and outputting the control signal which corresponds to the processing signal to the converter.

In accordance with one embodiment of the present invention, the processing signal further comprises the average lamp current signal and the pulse current signal.

In accordance with one embodiment of the present invention, the microprocessor comprises a microprocessing unit, a first digital-to-analog (D/A) converter, and a second digital-to-analog (D/A) converter. The microprocessing unit is configured for receiving the lamp state detection signal and the synchronization signal to generate a first digital signal which corresponds to the lamp state detection signal and a second digital signal which corresponds to the synchronization signal. The first D/A converter is configured for converting the first digital signal into the average lamp current signal. The second D/A converter is configured for converting the second digital signal into the pulse current signal.

In accordance with one embodiment of the present invention, the discharge lamp system further comprises an adder circuit for adding the average lamp current signal to the pulse current signal to generate a complex lamp current signal.

In accordance with one embodiment of the present invention, the adder circuit is disposed in the microprocessor and electrically connected to the first digital-to-analog converter and the second digital-to-analog converter, and the adder circuit generates the complex lamp current signal as the processing signal.

In accordance with one embodiment of the present invention, the adder circuit is disposed in the control circuit and electrically connected to the microprocessor, and the control circuit outputs the control signal to the converter according to the complex lamp current signal generated by the adder circuit.

In accordance with one embodiment of the present invention, the control circuit further comprises an operational amplifier, a pulse width modulation (PWM) signal generator and a driver. The operational amplifier has a positive phase input terminal, a negative phase input terminal and an output terminal, wherein the positive phase input terminal is configured for receiving the complex lamp current signal, the negative phase input terminal is configured for receiving a lamp current signal, and the negative phase input terminal is connected to the output terminal. The PWM signal generator is connected to the output terminal of the operational amplifier and configured for generating a pulse width modulation signal. The driver is connected to the pulse width modulation signal generator and configured for generating the control signal according to the pulse width modulation signal.

In accordance with one embodiment of the present invention, the control circuit further comprises a first operational amplifier, a second operational amplifier, a PWM signal generator and a driver. The first operational amplifier has a first positive phase input terminal, a first negative phase input terminal and a first output terminal, in which the first positive phase input terminal is configured for receiving a lamp current signal, and the first negative phase input terminal is connected to the second digital-to-analog converter and configured for receiving the pulse current signal. The second operational amplifier has a second positive phase input terminal, a second negative phase input terminal and a second output terminal, in which the second positive phase input terminal is connected to the first digital-to-analog converter and configured for receiving the average lamp current signal, and the second negative phase input terminal is connected to the first output terminal of the first operational amplifier and the second output terminal of the second operational amplifier. The PWM signal generator is connected to the second output terminal of the second operational amplifier and configured for generating a pulse width modulation signal. The driver is connected to the pulse width modulation signal generator and configured for generating the control signal according to the pulse width modulation signal.

In accordance with one embodiment of the present invention, the control circuit further comprises a gain amplifying unit electrically connected to the second digital-to-analog converter and the first output terminal of the first operational amplifier and configured for amplifying the pulse current signal.

In accordance with one embodiment of the present invention, the converter is a DC/DC converter.

In accordance with one embodiment of the present invention, the DC/DC converter is buck converter.

In accordance with one embodiment of the present invention, the buck converter comprises a switch having a first end, a second end and a control end, wherein the first end is connected to the power supply device, the second end is connected to the discharge lamp, and the control end is connected to the driver and configured for switching on or switching off the switch according to the control signal.

In accordance with one embodiment of the present invention, the switch is switched on or switched off according to the control signal to control an output current.

In accordance with one embodiment of the present invention, the lamp state signal is a signal corresponding to a lamp voltage, a lamp current or a lamp power of the discharge lamp.

In accordance with one embodiment of the present invention, the lamp state signal comprises a lamp voltage signal and a lamp current signal, the lamp state signal detection module comprises a lamp voltage detection unit and a lamp current detection unit, the lamp voltage detection unit is configured for detecting the lamp voltage of the discharge lamp to generate a lamp voltage detection signal, and the lamp current detection unit is configured for detecting the lamp current of the discharge lamp to generate a lamp current detection signal.

In accordance with one embodiment of the present invention, the lamp state signal comprises an input voltage signal and an input current signal which are provided by the power supply device, the lamp state signal detection module comprises an input voltage detection unit and an input current detection unit, the input voltage detection unit is configured for detecting the input voltage signal to generate an input voltage detection signal, and the input current detection unit is configured for detecting the input current signal to generate an input current detection signal.

Another aspect of the present invention is to provide a method for controlling a discharge lamp. The e method comprises the operations of (a) providing a synchronization signal and at least one lamp state signal; (b) generating an average lamp current signal and a pulse current signal according to the synchronization signal and the lamp state signal; (c) generating a control signal according to the average lamp current signal and the pulse current signal; and (d) performing current control of the discharge lamp according to the control signal.

In accordance with one embodiment of the present invention, the lamp state signal is a signal corresponding to a lamp voltage, a lamp current or a lamp power of the discharge lamp.

In accordance with one embodiment of the present invention, the lamp state signal comprises a lamp voltage signal and a lamp current signal.

In accordance with one embodiment of the present invention, the operation (c) further comprises the operations of adding the average lamp current signal to the pulse current signal to generate a complex lamp current signal and generating the control signal according to the complex lamp current signal.

In accordance with one embodiment of the present invention, the operation (c) further comprises the operations of comparing the complex lamp current signal with a lamp current signal to obtain a comparison signal, modulating pulse widths of the comparison signal to obtain a pulse width modulation signal, and amplifying the pulse width modulation signal to obtain the control signal.

For the discharge lamp system and the method for controlling the same disclosed in the embodiments of the present invention, the average lamp current signal and the pulse current signal are obtained according to the lamp state, preferably the lamp current and the lamp voltage, of the discharge lamp and the synchronization signal given by the projection system, and then the average lamp current signal and the pulse current signal are processed to generate the lamp current required for the color shown in the projection system. Then, the discharge lamp is controlled according to the lamp current so that the expected projection operation can be performed.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiments, with reference to the accompanying drawings as follows.

DESCRIPTION OF THE EMBODIMENTS

In the following description, several specific details are presented to provide a thorough understanding of the embodiments of the present invention. One skilled in the relevant art will recognize, however, that the present invention can be practiced without one or more of the specific details, or in combination with or with other components, etc. In other instances, well-known implementations or operations are not shown or described in detail to avoid obscuring aspects of various embodiments of the present invention.

The terms used in this specification generally have their ordinary meanings in the art and in the specific context where each term is used. The use of examples anywhere in this specification, including examples of any terms discussed herein, is illustrative only, and in no way limits the scope and meaning of the invention or of any exemplified term. Likewise, the present invention is not limited to various embodiments given in this specification.

As used herein, the terms "comprising," "including," "having," "containing," "involving," and the like are to be understood to be open-ended, i.e., to mean including but not limited to.

Reference throughout the specification to "one embodiment" or "an embodiment" means that a particular feature, structure, implementation, or characteristic described in connection with the embodiment is included in at least one embodiment of the present invention. Thus, uses of the phrases "in one embodiment" or "in an embodiment" in various places throughout the specification are not necessarily all referring to the same embodiment. Furthermore, the particular features, structures, implementation, or characteristics may be combined in any suitable manner in one or more embodiments.

Figure 1:
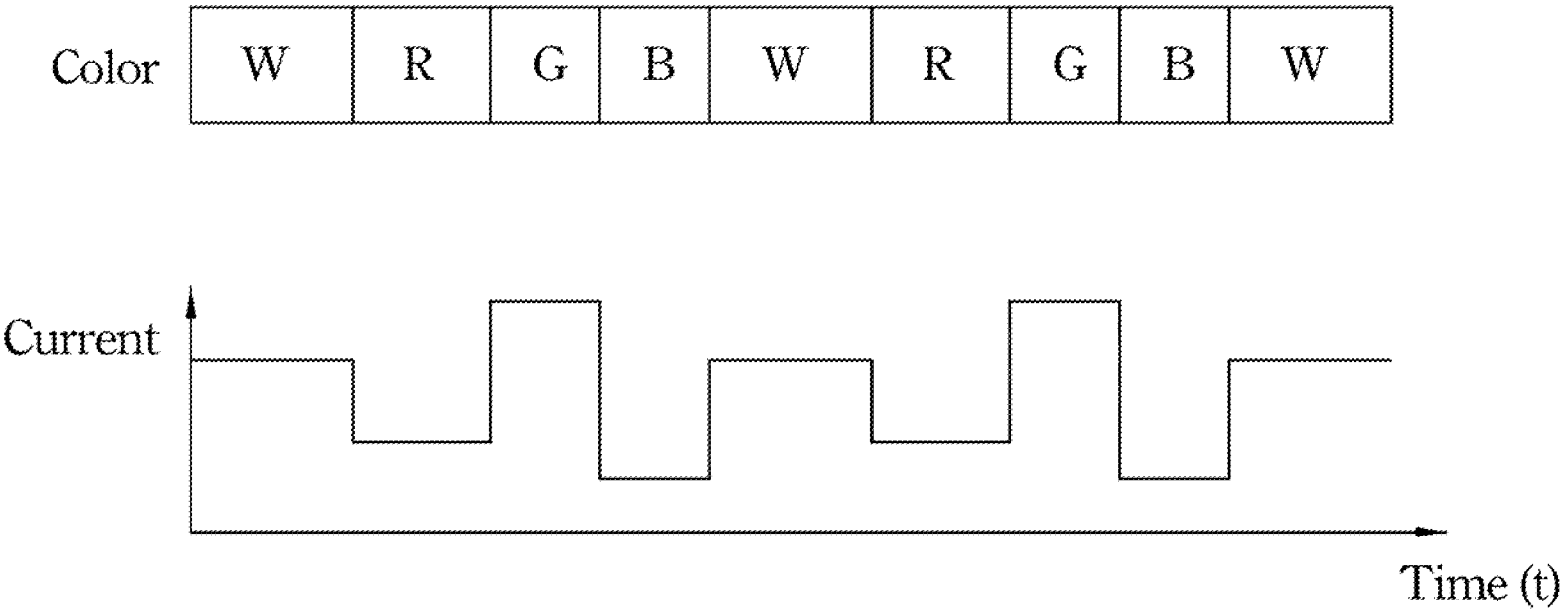
FIG. 1 is a diagram illustrating discharge lamp currents corresponding to the four color images generated by the four-color filter.
Figure 2:
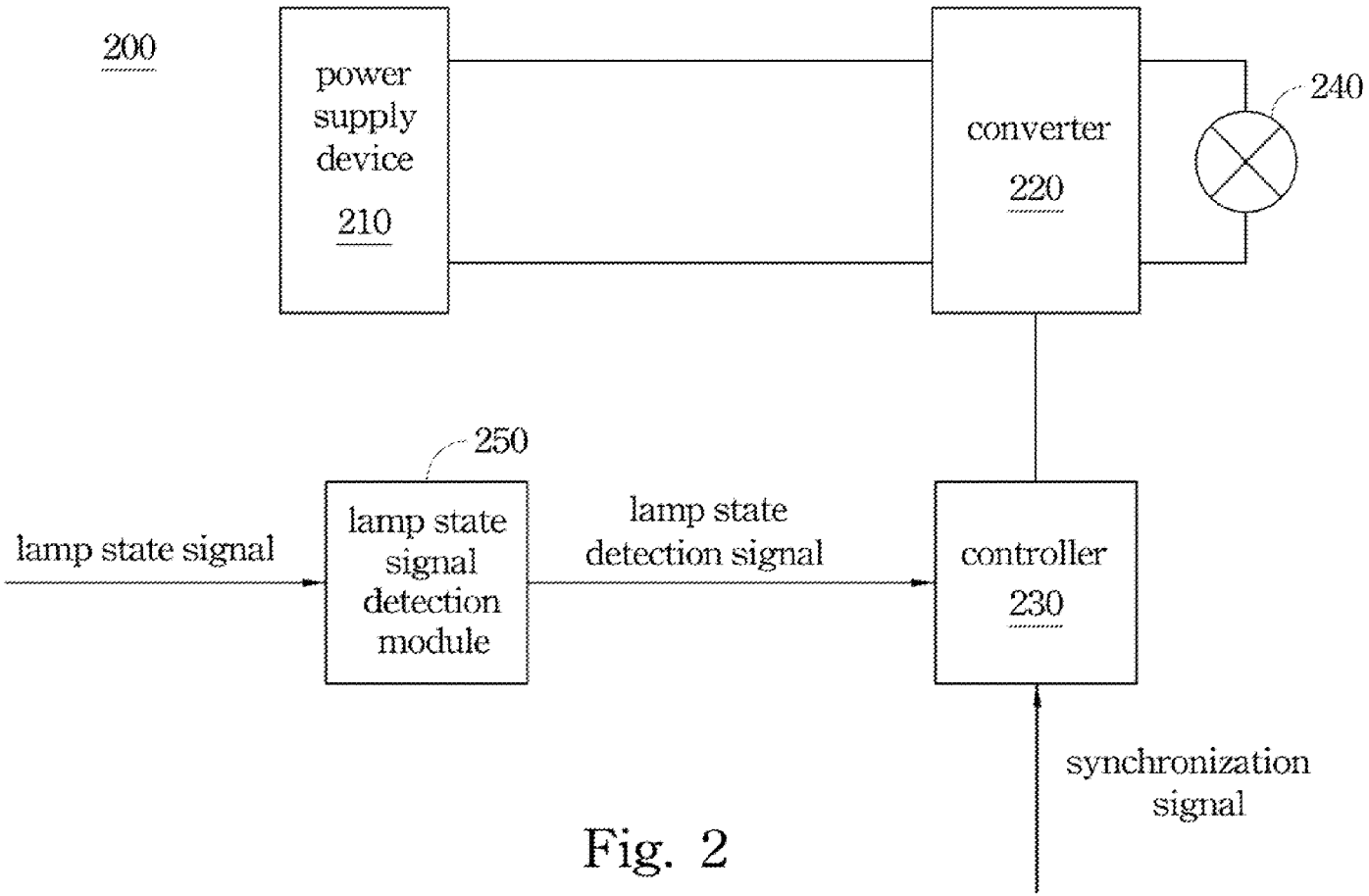
FIG. 2 is a diagram illustrating a discharge lamp system according to one embodiment of the present invention.

FIG. 2 is a diagram illustrating a discharge lamp system according to one embodiment of the present invention. As illustrated in FIG. 2, the discharge lamp system 200 includes a power supply device 210, a converter 220, a controller 230, a discharge lamp 240 and a lamp state signal detection module 250. The power supply device 210 is configured for providing a DC power. An end of the converter 220 is connected to the power supply device 210 and configured for receiving the DC power provided by the power supply device 210. The other end of the converter 220 is connected to the discharge lamp 240. The converter 220 is configured for converting the DC power which is provided by the power supply device 210 into a current required by the discharge lamp 240. The lamp state signal detection module 250 is configured for receiving a lamp state signal and outputting a lamp state detection signal. The controller 230 is connected to the lamp state signal detection module 250. The controller 230 is configured for receiving the lamp state detection signal and a synchronization signal to generate an average lamp current signal and a pulse current signal and for processing (e.g., adding, or adding in proportion) the average lamp current signal and the pulse current signal to generate a control signal. The controller 230 outputs the control signal to the converter 220. The converter 220 performs current control of the discharge lamp 240 according to the received control signal. Preferably, the discharge lamp 240 can be a high intensity gas discharge lamp, in which the lamp state signal detection module 250 is configured for detecting a lamp state signal and outputting the lamp state detection signal, and the controller 230 performs current control of the gas discharge lamp or power control of the gas discharge lamp in accordance with the output of the lamp state signal detection module 250.

Notably, the foregoing lamp state signal may be a signal corresponding to a lamp voltage, a lamp current or a lamp power of the discharge lamp 240, such as the lamp voltage, the lamp current or the lamp power of the discharge lamp 240, or the input voltage, the input current or the input power provided by the power supply device 210.

In the embodiments described below, the lamp state signal preferably includes the lamp voltage signal and the lamp current signal of the discharge lamp 240. Typically, the controller 230 can perform an open loop control of the power of the gas discharge lamp in accordance with only the lamp voltage of the gas discharge lamp, and also can perform a closed loop control of the power of the gas discharge lamp in accordance with the lamp voltage and lamp current of the gas discharge lamp. Different control manners can be selected to be used in practice according to the required control accuracy of the gas discharge lamp power. Thus, the manner that the lamp voltage of the discharge lamp 240 which is provided as the lamp state signal will not be described below in details. The discharge lamp 240 illustrated in the present disclosure may be a high intensity gas discharge lamp, and in addition, may be a DC lamp or an AC lamp.

Figure 3:
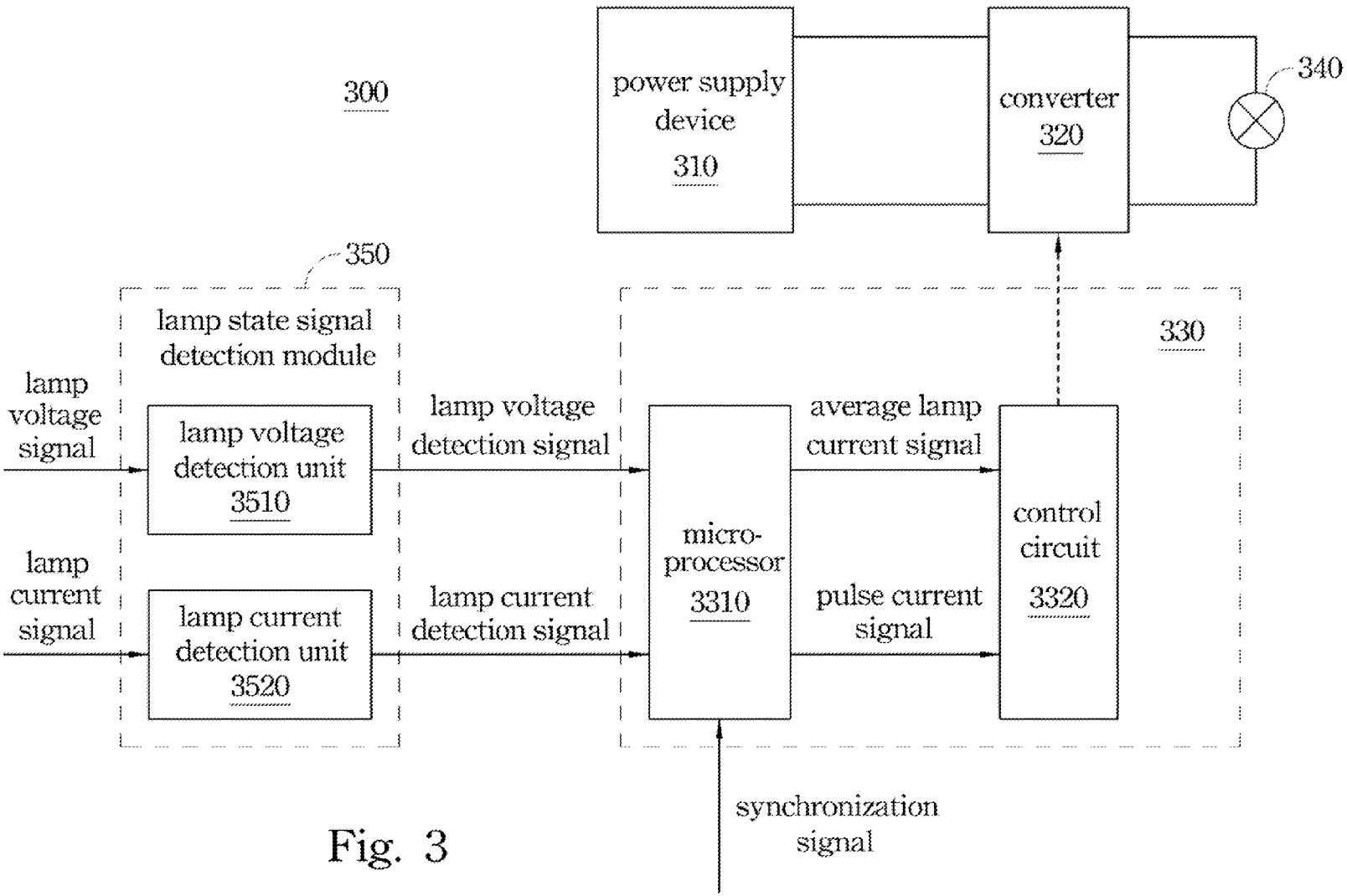
FIG. 3 is a configuration diagram illustrating a discharge lamp system according to one embodiment of the present invention.

FIG. 3 is a configuration diagram illustrating a discharge lamp system according to one embodiment of the present invention. As illustrated in FIG. 3, the discharge lamp system 300 includes a power supply device 310, a converter 320, a controller 330, a discharge lamp 340 and a lamp state signal detection module 350. The converter 320 is electrically connected between the power supply device 310 and the discharge lamp 340. The controller 330 is electrically connected to the lamp state signal detection module 350 and the converter 320.

The lamp state signal detection module 350 is configured for detecting a lamp state signal corresponding to the discharge lamp 340 and thus outputting the lamp state detection signal (i.e., outputting the signal corresponding to the lamp voltage, the lamp current or the lamp power of the discharge lamp 340), in which the lamp state signal may be a lamp voltage signal, a lamp current signal, or the input voltage/current signal provided by the power supply device 310. In the present embodiment, the lamp state signal preferably includes the lamp voltage signal and the lamp current signal. In the present embodiment, the lamp state signal detection module 350 further includes a lamp voltage detection unit 3510 and a lamp current detection unit 3520 that are configured for detecting the lamp voltage and the lamp current of the discharge lamp 340, respectively. The lamp voltage detection unit 3510 correspondingly outputs a lamp voltage detection signal, and the lamp current detection unit 3520 correspondingly outputs a lamp current detection signal.

In other embodiments, if the lamp state signal includes, for example, the input voltage signal and the input current signal provided by the power supply device 310, the lamp state signal detection module 350 may further include an input voltage detection unit and an input current detection unit that are configured for detecting the input voltage and the input current, respectively, provided by the power supply device 310 and for correspondingly outputting an input voltage detection signal and an input current detection signal.

The controller 330 may include a microprocessor 3310 and a control circuit 3320. The microprocessor 3310 is electrically connected to the output of the lamp state signal detection module 350, e.g., the output of the lamp voltage detection unit 3510 and the output of the lamp current detection unit 3520. The control circuit 3320 is electrically connected to the microprocessor 3310 and the converter 320. Specifically, the microprocessor 3310 is configured for receiving the lamp voltage detection signal, the lamp current detection signal and a given synchronization signal (the synchronization signal is, for example, a given periodical synchronization signal in a projection system and related with information of the rotation of the color wheel) to further generate a processing signal.

In the present embodiment, the processing signal preferably includes an average lamp current signal and a pulse current signal. The control circuit 3320 is configured for generating a control signal according to the processing signal provided by the microprocessor 3310. Thereafter, the control signal is transmitted to the converter 320, and the converter 320 can perform current control of the discharge lamp 340 according to the control signal. Specifically, the state (e.g., the constant current stage or constant power stage) of the discharge lamp 340 can be determined by the lamp voltage detection signal which corresponds to the discharge lamp 340. If the discharge lamp 340 is operated at the constant power stage, the discharge lamp 340 is controlled with constant power, a lamp power signal can be obtained in accordance with the lamp voltage detection signal and the lamp current detection signal. Moreover, in the present embodiment, the lamp current of the discharge lamp 340 can be controlled so that the discharge lamp 340 can be controlled with constant power.

Figure 4:
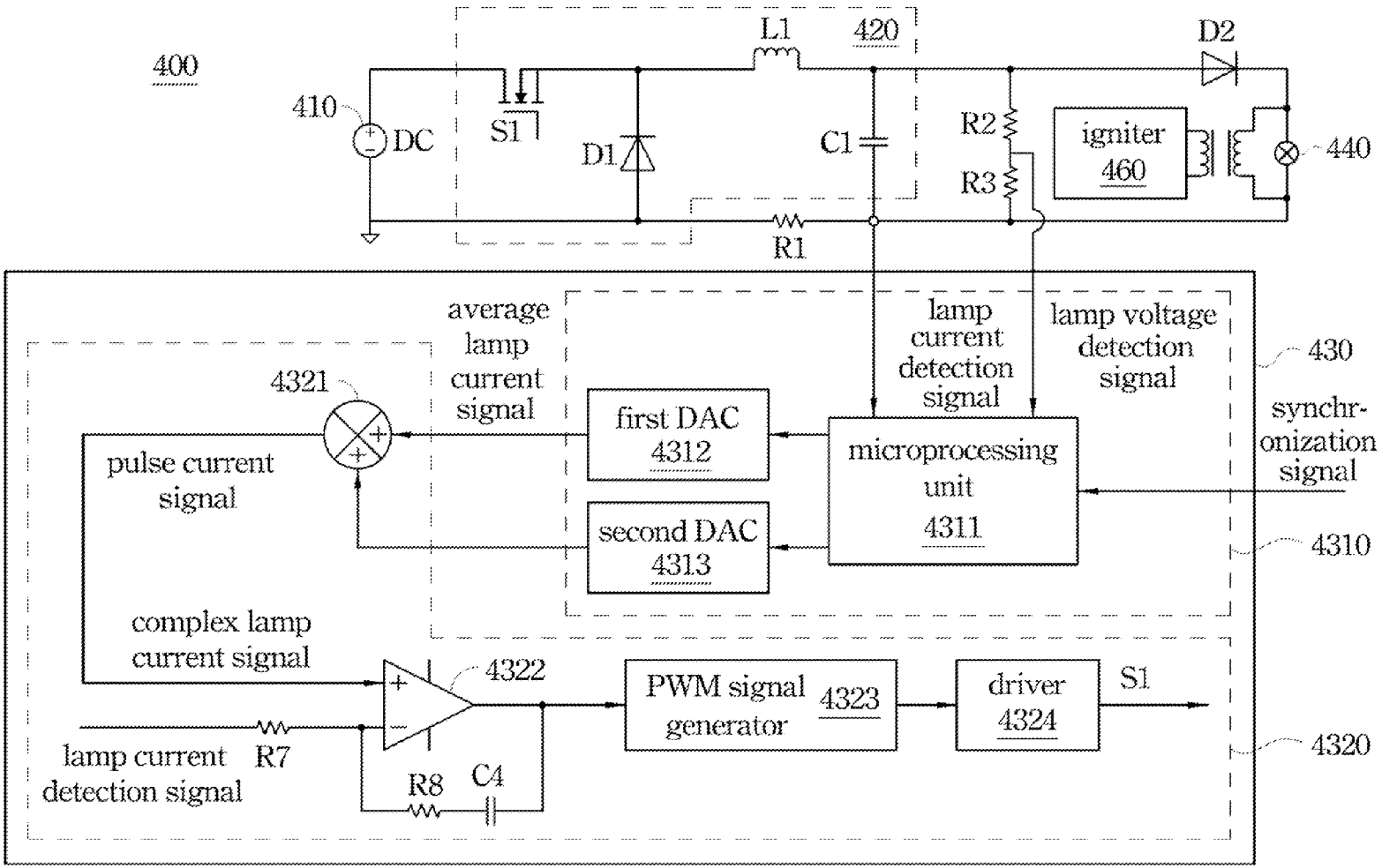
FIG. 4 is a circuit configuration diagram illustrating the discharge lamp system shown in FIG. 3 according to one embodiment of the present invention.

FIG. 4 is a circuit configuration diagram illustrating the discharge lamp system shown in FIG. 3 according to one embodiment of the present invention. As illustrated in FIG. 4, the discharge lamp system 400 includes a power supply device 410, a converter 420, a discharge lamp 440, a lamp state signal detection module (not shown), an igniter 460 and a controller 430. In the present embodiment, the power supply device 410 can be a direct-current (DC) power source or, preferably, a DC voltage source, for providing a DC power. In the present embodiment, the converter 420 can be a DC/DC converter or, preferably, a buck converter, which has one end connected to the output of the DC power source and is configured for converting the DC power provided by the DC power source into the current required by the discharge lamp 440. The converter 420 (e.g., buck converter) may include a MOSFET (or switch) S1, a diode D1, an inductor L1 and a capacitor C1. In the present embodiment, the igniter 460 is connected in parallel with the discharge lamp 440. The discharge lamp system 400 may further include another diode D2 which is connected in series with the discharge lamp 440, for preventing other circuits from being damaged by the high voltage required for the activation of the discharge lamp 440.

As mentioned above, the lamp state signal detection module (not shown) can detect the lamp voltage signal and the lamp current signal and correspondingly generate the lamp voltage detection signal and the lamp current detection signal. In the present embodiment, the lamp voltage can be detected and indirectly obtained by employing the voltage dividing element (e.g., resistor) and/or the voltage step-down element (e.g., diode); for example, in FIG. 4 the lamp voltage detection signal is obtained by employing the resistors R2 and R3. Notably, the lamp voltage can be used for determining the state of the discharge lamp 440 in one aspect (i.e., determining that the discharge lamp 440 is operated at the constant current control stage or the constant power control stage), and the lamp voltage can be used for controlling the discharge lamp 440 in the other aspect. On the other hand, the detection of the lamp current can be performed by detecting the current flowing through the inductor L1. Specifically, the average current flowing through the capacitor C1 is zero, so the average current flowing through the inductor L1 is the same as the average of lamp current, and the average current flowing through the inductor L1 would be transformed into the voltage signal (i.e., the lamp current detection signal transmitted from the converter 420 shown in FIG. 4) by the resistor R1.

In the present embodiment, the controller 430 may include a microprocessor 4310 and a control circuit 4320.

The microprocessor 4310 includes a microprocessing unit 4311, a first digital-to-analog (D/A) converter 4312 and a second digital-to-analog (D/A) converter 4313. The microprocessing unit 4311 generates a first digital signal (which corresponds to the average lamp current signal) in accordance with the lamp voltage detection signal and the lamp current detection signal outputted by the lamp state signal detection module. Specifically, the microprocessing unit 4311 determines the state (e.g., the constant current stage or constant power stage) of the discharge lamp 440 according to the lamp voltage detection signal and the lamp current detection signal. If the discharge lamp 440 is operated at the constant power stage, the lamp power signal can be generated according to the lamp voltage detection signal and the lamp current detection signal.

In the present embodiment, the lamp current of the discharge lamp 440 is controlled to perform constant power control operation, and the microprocessing unit 4311 may generate the first digital signal which corresponds to the average lamp current signal according to the lamp voltage detection signal and the lamp current detection signal. Furthermore, the microprocessing unit 4311 receives and processes the synchronization signal given by an external system (e.g., projection system) to generate a second digital signal which corresponds to the pulse current signal. The first D/A converter 4312 converts the first digital signal outputted by the microprocessing unit 4311 into the average lamp current signal.

Figure 4A:
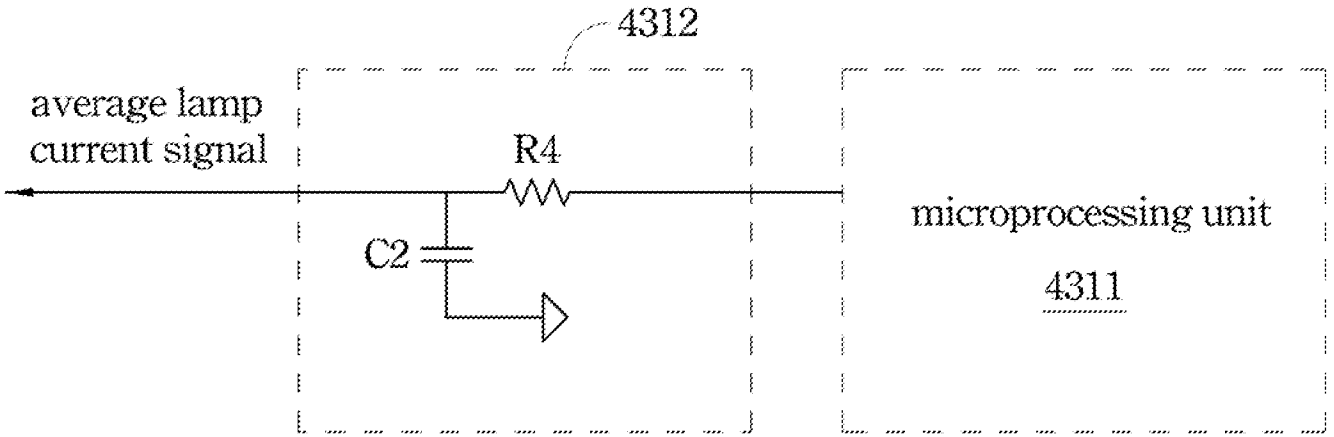
FIG. 4A is a circuit diagram of the first D/A converter shown in FIG. 4.
Figure 4B:
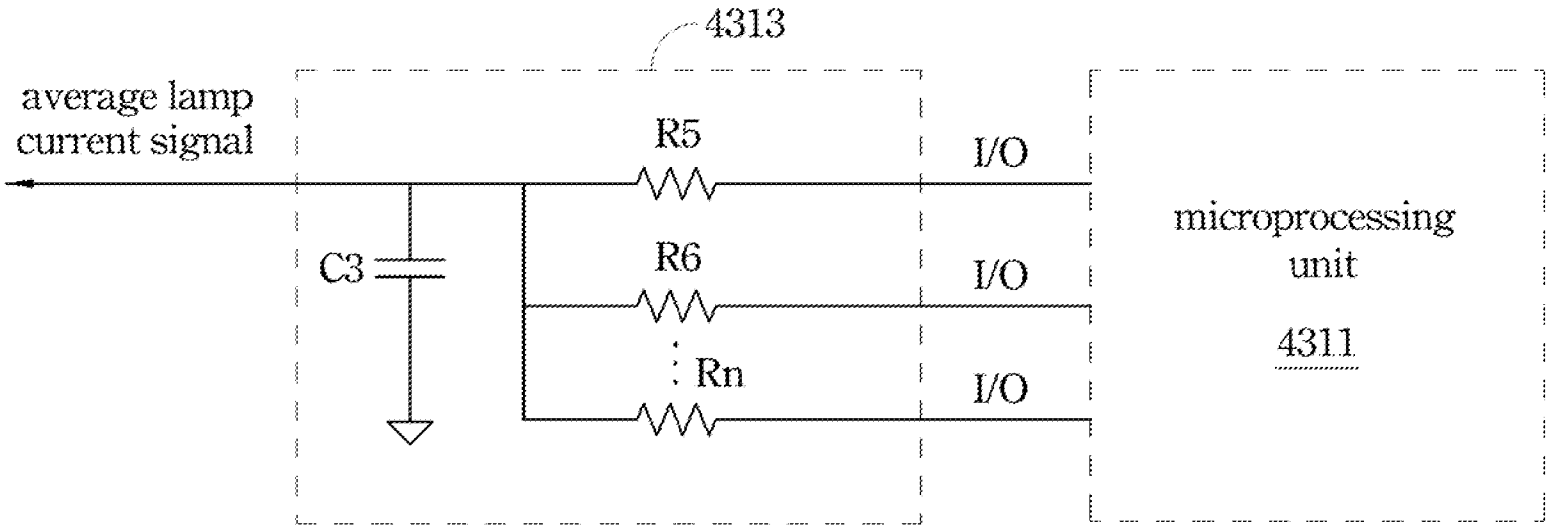
FIG. 4B is a circuit diagram of the second D/A converter shown in FIG. 4.

In the present embodiment, the first D/A converter 4312 can be a low pass filter as shown in FIG. 4A. FIG. 4A is a circuit diagram of the first D/A converter shown in FIG. 4. The low pass filter is consisted of a resistor R4 and a capacitor C2. The second D/A converter 4313 processes the second digital signal to generate the pulse current signal. FIG. 46 is a circuit diagram of the second D/A converter shown in FIG. 4. Notably, the circuits shown in FIG. 4A and FIG. 4B can be implemented by other types of circuits, and they are not limiting of this invention. As shown in FIG. 4B, the second D/A converter 4313 includes several resistors R5, R6, . . . , Rn and a capacitor C3, in which ends of the resistors R5, R6, . . . , Rn are correspondingly connected to input/output (I/O) ports (which are used for transmitting the second digital signal) of the microprocessing unit 4311, and the other ends of the resistors R5, R6, . . . , Rn are connected one end of the capacitor C3 at a node.

Specifically, as shown in FIG. 4B, the second digital signal is transmitted through the I/O ports to the resistors (e.g., R5, R6, . . . , Rn), and the resistors can be provided for regulating the amplitudes of the signals outputted through the I/O ports. For example, assuming that there are only two resistors R5 and R6 which have same value of resistance, that the I/O port which corresponds to the resistor R5 outputs a high voltage level signal (e.g., voltage level of 5V), and that the I/O port which corresponds to the resistor R6 outputs a low voltage level signal (e.g., voltage level of 0 V), then the pulse current signal will be the signal with the voltage level of 2.5 V such that the pulse current signal can be a pulse signal with a required amplitude. In the foregoing embodiments, the number and value of the resistors are not limiting of the invention, so different voltage signals can be obtained from the signals outputted by the I/O ports and the resistors and then the capacitor C3 filters the voltage signals to generate the pulse current signal.

Notably, the amplitude (which can be known from the signals outputted by the I/O ports and the resistors R5, R6, . . . , Rn) of the pulse current signal is determined by the synchronization signal given by the projection system. Since the synchronization signal can be generated corresponding to the color of light emitted from the projection system and the intensity of the lamp current of the discharge lamp, which is required by each color of light, the synchronization signal can be used for determining the amplitude of the pulse current signal.

It is still notable that the amplitude of the pulse current signal may be proportional to the amplitude of the average lamp current signal. For example, assuming that the intensity of the currents required for the green (G) color and the blue (B) color can be determined according to the synchronization signal, and that in the microprocessing unit the current required for the green (G) color is 120% of the average lamp current signal and the current required for the blue (B) color is 80% of the average lamp current signal, then the amplitude of the pulse current signal corresponding to the green (G) color is 20% of the average lamp current signal, and the amplitude of the pulse current signal corresponding to the (B) color is −20% of the average lamp current signal. The foregoing description is made exemplarily but not limiting of the invention.

The control circuit 4320 may include an adder circuit 4321, an operational amplifier 4322, a pulse width modulation (PWM) signal generator 4323 and a driver 4324. The adder circuit 4321 is configured for adding the average lamp current signal to the pulse current signal to generate a complex lamp current signal. The complex lamp current signal is inputted into the positive phase input terminal of the operational amplifier 4322 and used as a reference signal. The lamp current detection signal is inputted through the resistor R7 into the negative phase input terminal of the operational amplifier 4322. In addition, the output terminal of the operational amplifier 4322 is connected to the negative phase input terminal of the operational amplifier 4322 through a capacitor C4 and a resistor R8. The circuit consisted of the capacitor C4 and the resistor R8 can be implemented by other circuits and is not limiting of the present invention. Notably, in the present embodiment, the complex lamp current signal not only can be used for controlling the lamp current detection signal inputted into the negative phase input terminal of the operational amplifier 4322, but also can be used for controlling a feedback signal outputted from the output terminal of the operational amplifier 4322. The operational amplifier 4322 processes the received input signals and outputs a signal as the input signal for the PWM signal generator 4323. After that, the PWM signal generator 4323 generates a PWM signal, and the driver 4324 converts the PWM signal into the control signal. The control signal is a switch signal for the switch S1 and used for switching on or switching off the switch S1 so as to perform current control of the discharge lamp 440.

Figure 5:
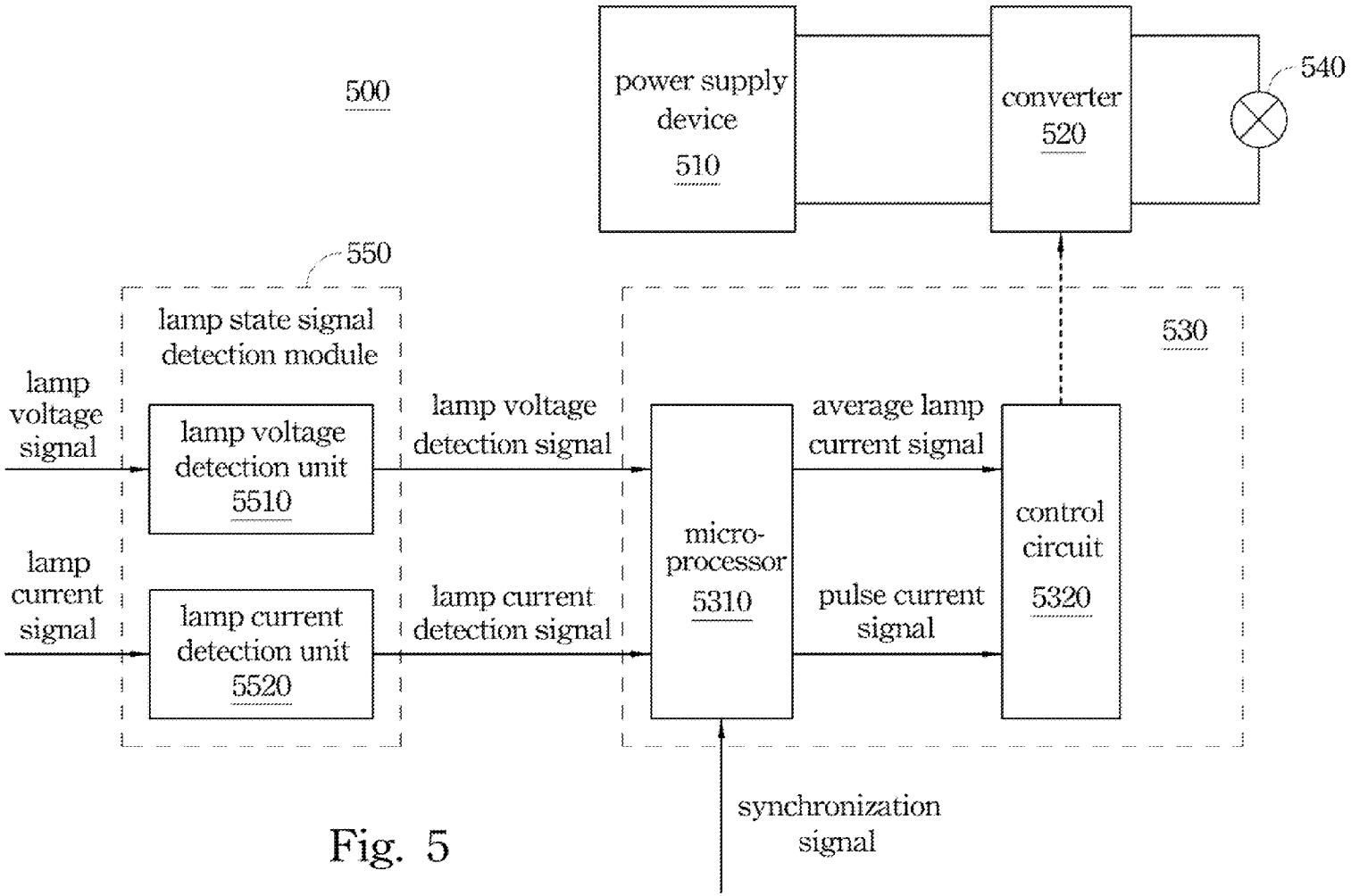
FIG. 5 is a configuration diagram illustrating a discharge lamp system according to another embodiment of the present invention.

FIG. 5 is a configuration diagram illustrating a discharge lamp system according to another embodiment of the present invention. As illustrated in FIG. 5, the discharge lamp system 500 includes a power supply device 510, a converter 520, a controller 530, a discharge lamp 540 and a lamp state signal detection module 550 (including a lamp voltage detection unit 5510 and a lamp current detection unit 5520). Compared to the discharge lamp system shown in FIG. 3, in the discharge lamp system 500 shown in FIG. 5, the microprocessor 5310 outputs the complex lamp current signal, instead of the average lamp current signal and the pulse current signal, after processing the lamp voltage detection signal, the lamp current detection signal and the synchronization signal. Then the control circuit 5320 processes the complex lamp current signal to output a control signal to the converter 520, in which the controller 530 employs the control signal to control the discharge lamp 540 through the converter 520. The other circuits and parts in the discharge lamp system 500 are the same as or similar to those shown in FIG. 3, so they are not described in more detail herein for purposes of simplicity of explanation.

Figure 6:
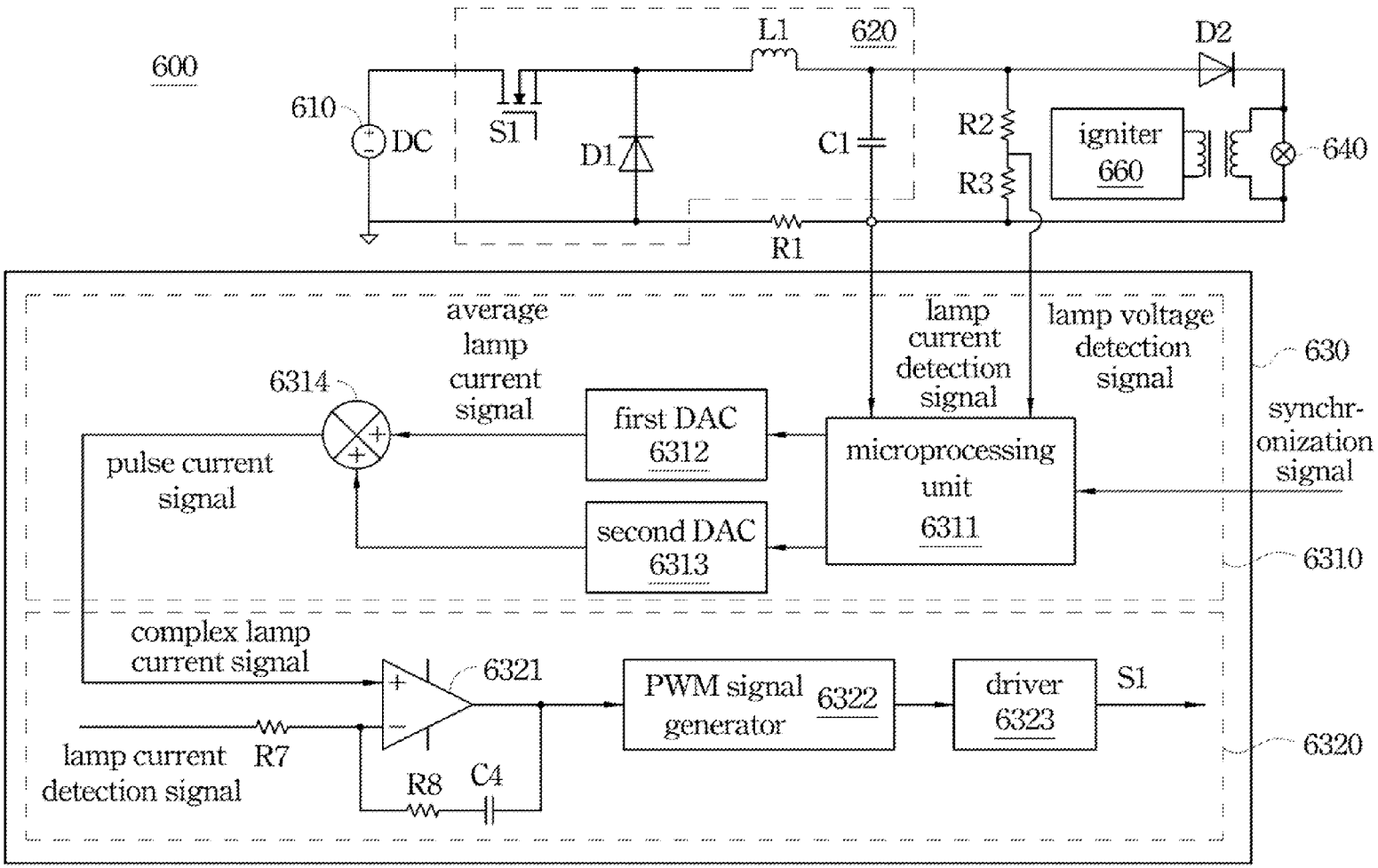
FIG. 6 is a circuit configuration diagram illustrating the discharge lamp system shown in FIG. 5 according to one embodiment of the present invention.

FIG. 6 is a circuit configuration diagram illustrating the discharge lamp system shown in FIG. 5 according to one embodiment of the present invention. As illustrated in FIG. 6, the discharge lamp system 600 includes a DC power source 610, a DC/DC converter 620, a discharge lamp 640, an igniter 660 and a controller 630. Compared to that shown in FIG. 4, in the present embodiment the adder circuit 6314 is included and disposed in the microprocessor 6310 but not included in the control circuit 6320. The adder circuit 6314 is configured for adding the average lamp current signal to the pulse current signal to generate a complex lamp current signal. The complex lamp current signal is inputted into the positive phase input terminal of the operational amplifier 6321. Since the other parts in the present embodiment are the same as or similar to those shown in FIG. 4, so they are not described in more detail herein for purposes of simplicity of explanation.

Figure 7A:
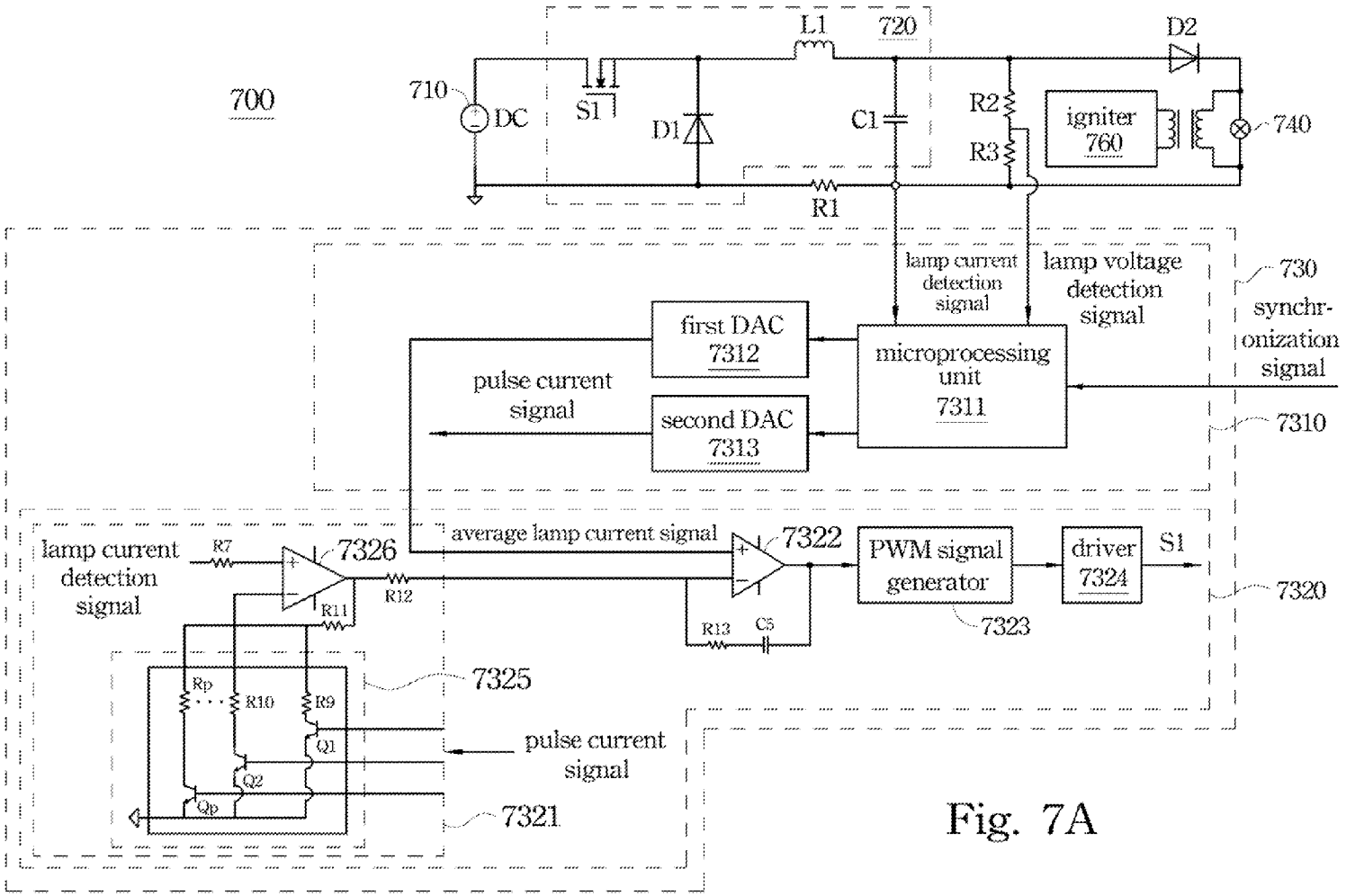
FIG. 7A is a circuit configuration diagram illustrating the discharge lamp system according to still another embodiment of the present invention.

FIG. 7A is a circuit configuration diagram illustrating the discharge lamp system according to still another embodiment of the present invention. As illustrated in FIG. 7A, the discharge lamp system 700 includes a DC power source 710, a DC/DC converter 720, a discharge lamp 740, a lamp state signal detection module (not shown), an igniter 760 and a controller 730. In the present embodiment, the controller 730 is different from that shown in FIG. 4 and will be described in detail below. The controller 730 includes a microprocessor 7310 and a control circuit 7320.

Figure 7B:
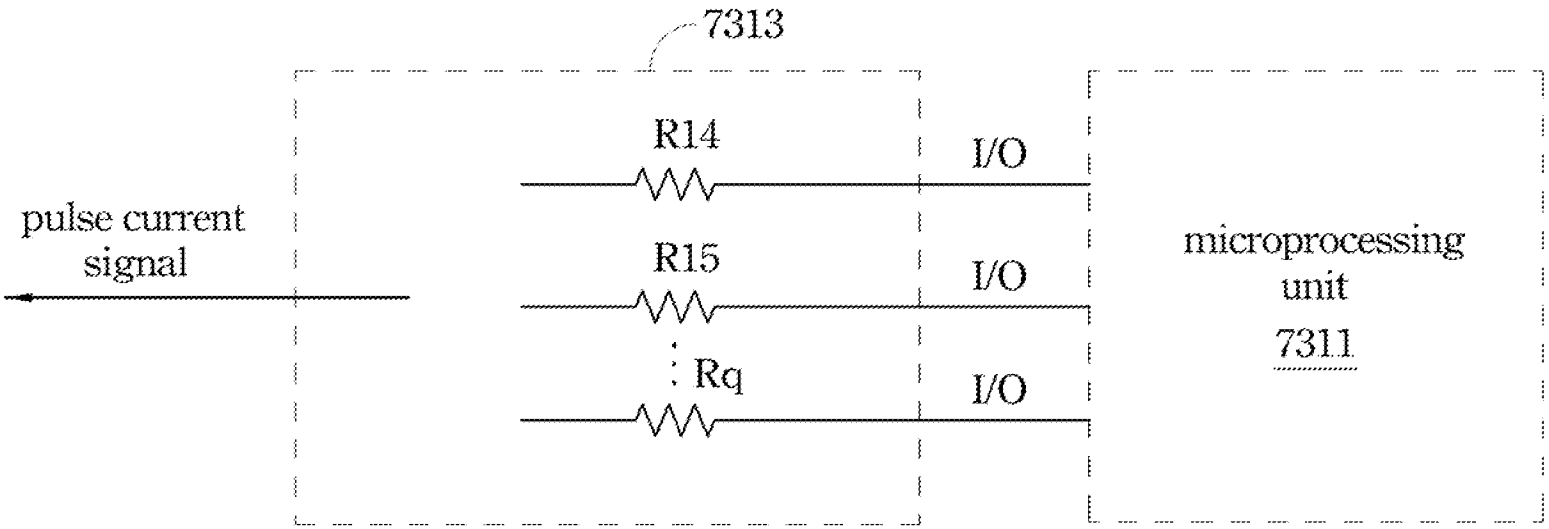
FIG. 7B is a circuit configuration diagram illustrating the second D/A converter shown in FIG. 7A according to one embodiment of the present invention.

The microprocessor 7310 includes a microprocessing unit 7311, a first D/A converter 7312 and a second D/A converter 7313. The microprocessing unit 7311 is configured for processing the lamp state detection signal detected by the lamp state signal detection module. In the present embodiment, the microprocessing unit 7311 is configured for processing the lamp voltage detection signal and the lamp current detection signal to generate a first digital signal (which corresponds to the average lamp current signal) and to generate a second digital signal (which corresponds to the pulse current signal) according to the synchronization signal given by the external system (projection system). The first digital signal is converted by the first D/A converter 7312 into the average lamp current signal. In the present embodiment, the circuit configuration of the first D/A converter 7312 can be the same illustrated in FIG. 4A. The second digital signal is converted by the second D/A converter 7313 into the pulse current signal. In the present embodiment, the circuit configuration of the second D/A converter 7313 can be the same illustrated in FIG. 7B. FIG. 7B is a circuit configuration diagram illustrating the second D/A converter shown in FIG. 7A according to one embodiment of the present invention.

The control circuit 7320 may include a lamp current processing circuit 7321, an operational amplifier 7322, a PWM signal generator 7323 and a driver 7324. The lamp current processing circuit 7321 includes a gain control circuit 7325 and an operational amplifier 7326. In the present embodiment, the gain control circuit 7325 includes a plurality of transistors Q1, Q2, . . . , Qp which have bases correspondingly connected to the resistors R14, R15, . . . , Rq shown in FIG. 7B. The gain control circuit 7325 further includes a plurality of resistors R9, R10, . . . , Rp which have ends correspondingly connected to the collectors of the transistors Q1, Q2, . . . , Qp and have the other ends connected at one node and to the negative phase input terminal of the operational amplifier 7326. The lamp current detection signal is inputted through the resistor R7 to the positive phase input terminal of the operational amplifier 7326, and the output terminal and the negative phase input terminal of the operational amplifier 7326 are coupled to each other through a resistor R11. The signal inputted into the positive phase input terminal of the operational amplifier 7322 is the average lamp current signal, and the signal inputted into the negative phase input terminal of the operational amplifier 7322 is the signal outputted by the operational amplifier 7326 through a resistor R12. The negative phase input terminal and the output terminal of the operational amplifier 7322 are coupled to each other through a resistor R13 and a capacitor C5. Notably, the circuit consisted of the resistor R13 and the capacitor C5 in FIG. 7A can be implemented by other circuits and is not limiting of the present invention. The PWM signal generator 7323 is configured for generating a PWM signal according to the output signal outputted by the operational amplifier 7322. The driver 7324 generates the control signal according to the PWM signal to further control the switch S1 and to perform current control of the discharge lamp 740.

Figure 8:
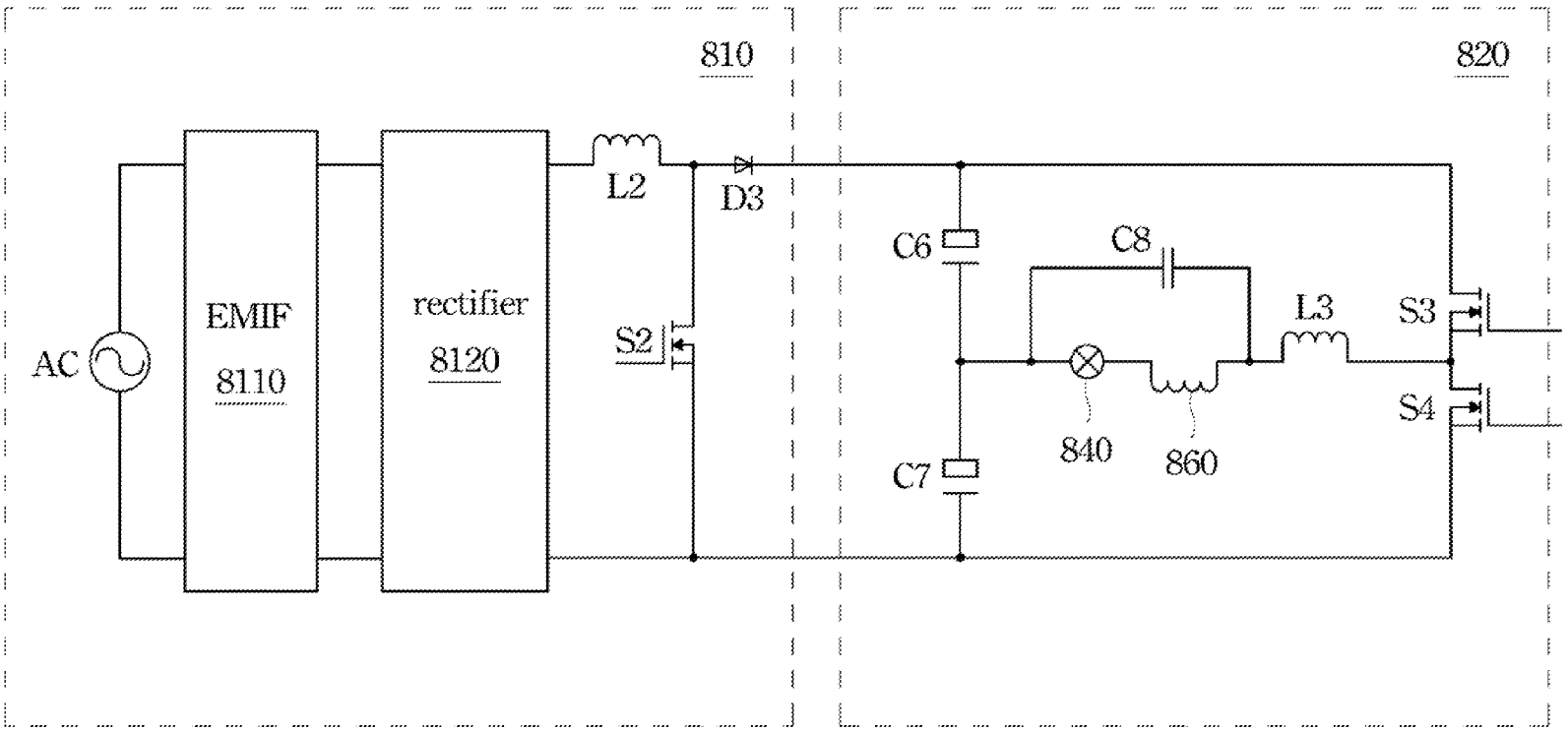
FIG. 8 is a portion of a circuit configuration diagram illustrating the discharge lamp system according to yet another embodiment of the present invention.

FIG. 8 is a portion of a circuit configuration diagram illustrating the discharge lamp system according to yet another embodiment of the present invention. As illustrated in FIG. 8, the power supply device 810 may include a power source AC, an electromagnetic interference (EMI) filter 8110, a rectifier 8120 and a power factor correction (PFC) circuit, in which the power source AC can be an AC current source. One end of the EMI filter 8110 is connected to the power source AC for filtering the signal interfering with the power source AC. One end of the rectifier 8120 is connected to the other end of the EMI filter 8110, and the rectifier 8120 can be configured for transforming the AC power provided by the power source AC into the DC power. The PFC circuit includes an inductor L2, a diode D3 and a first MOSFET S2, and the PFC circuit can be configured for boosting the input voltage. The converter 820 may be half bridge inverter. In the present embodiment, the discharge lamp 840 can be an AC lamp. The half bridge inverter includes two electrolyte capacitors C6 and C7 connected in series, an inductor L3 connected in series with the discharge lamp 840, a capacitor C8 connected in parallel with the discharge lamp 840, a, igniter circuit 860 connected in series with the discharge lamp 840, a second MOSFET S3 (switch S3) and a third MOSFET S4 (switch S4).

Notably, the converter 820 can be a full bridge inverter, the combination of a buck circuit and a half bridge inverter, or the combination of a buck circuit and a full bridge inverter, and the circuit of the converter 820 shown in FIG. 8 is not limiting of the present invention. On the other hand, the controller can be implemented by the circuit configuration mentioned above.

As can be known above, the discharge lamp system disclosed in the embodiments of the present invention, the power supply device can be a DC power source, an AC power source, other circuits, or the combination thereof, and it is not limiting of the present invention. Thus, any circuit which can provide the power for the discharge lamp can be implemented in the discharge lamp system. Moreover, the converter is preferably a buck circuit, or can be a half bridge inverter or a full bridge inverter, or even can be the combination of a buck circuit and a full bridge inverter or the combination of a buck circuit and a half bridge inverter, and thus it is not limited to those shown in the embodiments of the present invention.

Figure 9:
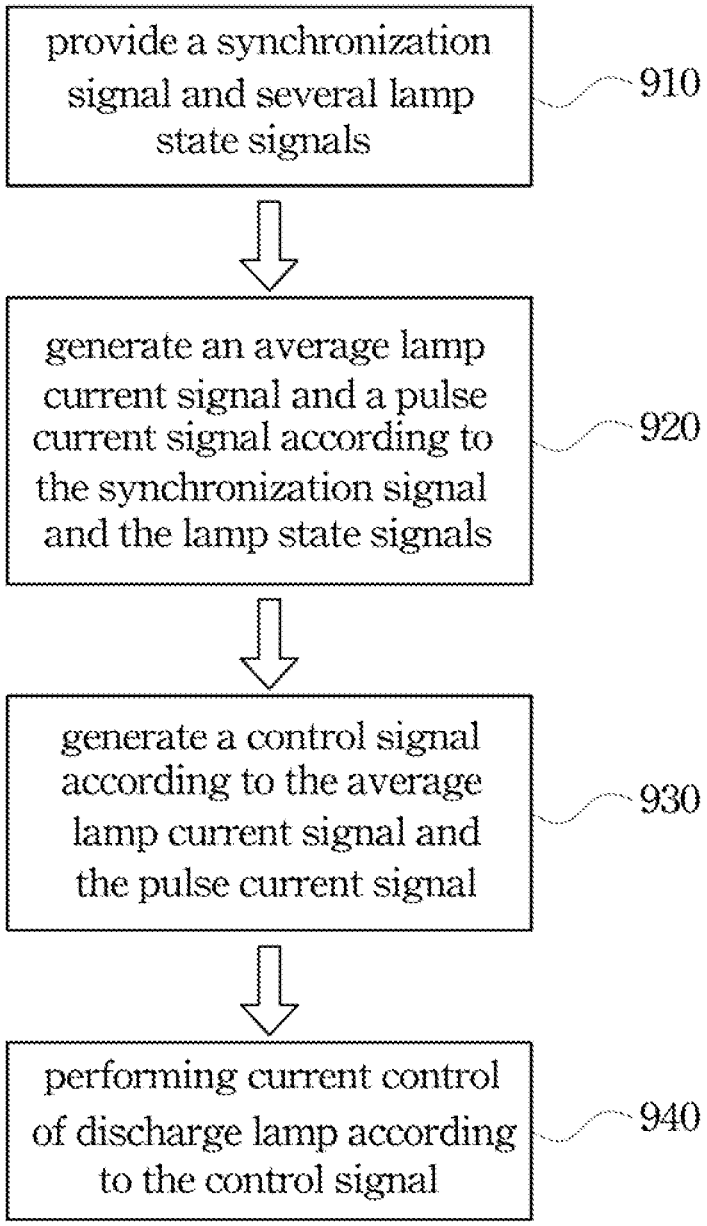
FIG. 9 is a flowchart of a method for controlling a discharge lamp according to one embodiment of the present invention.

FIG. 9 is a flowchart of a method for controlling a discharge lamp according to one embodiment of the present invention. As illustrated in FIG. 9, at operation 910, a synchronization signal and several lamp state signals are provided. Then, at operation 920, an average lamp current signal and a pulse current signal are generated according to the synchronization signal and the lamp state signal. After that, at operation 930, a control signal is generated according to the average lamp current signal and the pulse current signal. Thereafter, at operation 940, current control of the discharge lamp is performed according to the control signal.

In the present embodiment, the lamp state signal is preferably detected by a lamp state detection module.

In the present embodiment, the lamp state signal is a signal corresponding to a lamp voltage, a lamp current or a lamp power of the discharge lamp.

In the present embodiment, the lamp state signal comprises a lamp voltage signal and a lamp current signal.

In one embodiment, the operation 930 may include the following operations. First, the average lamp current signal is added to the pulse current signal to generate a complex lamp current signal. Then, the control signal is generated according to the complex lamp current signal. Moreover, the operation 930 may further include the following operations. The complex lamp current signal is compared with a lamp current signal to obtain a comparison signal. Also, pulse widths of the comparison signal are modulated to obtain a pulse width modulation signal. In addition, the pulse width modulation signal is amplified to obtain the control signal.

For the discharge lamp system and the method for controlling the same disclosed in the embodiments of the present invention, the average lamp current signal and the pulse current signal are obtained according to the lamp state, preferably the lamp current and the lamp voltage, of the discharge lamp and the synchronization signal given by the projection system, and then the average lamp current signal and the pulse current signal are processed to generate the lamp current required for the color shown in the projection system. Then, the discharge lamp is controlled according to the lamp current so that the expected projection operation can be performed.

The steps are not recited in the sequence in which the steps are performed. That is, unless the sequence of the steps is expressly indicated, the sequence of the steps is interchangeable, and all or part of the steps may be simultaneously, partially simultaneously, or sequentially performed.

As is understood by a person skilled in the art, the foregoing embodiments of the present invention are illustrative of the present invention rather than limiting of the present invention. It is intended to cover various modifications and similar arrangements included within the spirit and scope of the appended claims, the scope of which should be accorded with the broadest interpretation so as to encompass all such modifications and similar structures.

What is claimed is:

1. A discharge lamp system comprising:

a discharge lamp;

a power supply device for providing a DC power;

a converter connected to the power supply device and the discharge lamp and configured for converting the DC power into a current required by the discharge lamp;

a lamp state signal detection module for receiving a lamp state signal and outputting a lamp state detection signal; and a controller connected to the lamp state signal detection module and configured for receiving the lamp state detection signal and a synchronization signal to generate an average lamp current signal and a pulse current signal, which corresponds to the lamp state detection signal and the synchronization signal, and for outputting a control signal which corresponds to the average lamp current signal and the pulse current signal to the converter, wherein the controller further comprises:

a microprocessor for receiving the lamp state detection signal and the synchronization signal and generating a processing signal which corresponds to the current control of the discharge lamp, wherein the microprocessor comprises:

a microprocessing unit for receiving the lamp state detection signal and the synchronization signal to generate a first digital signal which corresponds to the lamp state detection signal and a second digital signal which corresponds to the synchronization signal;

a first digital-to-analog (D/A) converter for converting the first digital signal into the average lamp current signal; and a second digital-to-analog (D/A) converter for converting the second digital signal into the pulse current signal; and a control circuit connected to the microprocessor and configured for receiving the processing signal and outputting the control signal which corresponds to the processing signal to the converter, wherein the processing signal further comprises the average lamp current signal and the pulse current signal;

wherein the converter performs current control of the discharge lamp according to the received control signal.

2. The discharge lamp system as claimed in claim 1, wherein the control circuit further comprises:

a first operational amplifier having a first positive phase input terminal, a first negative phase input terminal and a first output terminal, wherein the first positive phase input terminal is configured for receiving a lamp current signal, and the first negative phase input terminal is connected to the second digital-to-analog converter and configured for receiving the pulse current signal;

a second operational amplifier having a second positive phase input terminal, a second negative phase input terminal and a second output terminal, wherein the second positive phase input terminal is connected to the first digital-to-analog converter and configured for receiving the average lamp current signal, and the second negative phase input terminal is connected to the first output terminal of the first operational amplifier and the second output terminal of the second operational amplifier;

a pulse width modulation (PWM) signal generator connected to the second output terminal of the second operational amplifier and configured for generating a pulse width modulation signal; and a driver connected to the pulse width modulation signal generator and configured for generating the control signal according to the pulse width modulation signal.

3. The discharge lamp system as claimed in claim 2, wherein the control circuit further comprises:

a gain amplifying unit electrically connected to the second digital-to-analog converter and the first output terminal of the first operational amplifier and configured for amplifying the pulse current signal.

4. The discharge lamp system as claimed in claim 1, wherein the lamp state signal is a signal corresponding to a lamp voltage, a lamp current or a lamp power of the discharge lamp.

5. The discharge lamp system as claimed in claim 4, wherein the lamp state signal comprises a lamp voltage signal and a lamp current signal, the lamp state signal detection module comprises a lamp voltage detection unit and a lamp current detection unit, the lamp voltage detection unit is configured for detecting the lamp voltage of the discharge lamp to generate a lamp voltage detection signal, and the lamp current detection unit is configured for detecting the lamp current of the discharge lamp to generate a lamp current detection signal.

6. The discharge lamp system as claimed in claim 4, wherein the lamp state signal comprises an input voltage signal and an input current signal which are provided by the power supply device, the lamp state signal detection module comprises an input voltage detection unit and an input current detection unit, the input voltage detection unit is configured for detecting the input voltage signal to generate an input voltage detection signal, and the input current detection unit is configured for detecting the input current signal to generate an input current detection signal.

7. The discharge lamp system as claimed in claim 1, further comprising:

an adder circuit for adding the average lamp current signal to the pulse current signal to generate a complex lamp current signal.

8. The discharge lamp system as claimed in claim 7, wherein the adder circuit is disposed in the microprocessor and electrically connected to the first digital-to-analog converter and the second digital-to-analog converter, and the adder circuit generates the complex lamp current signal as the processing signal.

9. The discharge lamp system as claimed in claim 7, wherein the adder circuit is disposed in the control circuit and electrically connected to the microprocessor, and the control circuit outputs the control signal to the converter according to the complex lamp current signal generated by the adder circuit.

10. The discharge lamp system as claimed in claim 7, wherein the control circuit further comprises:

an operational amplifier having a positive phase input terminal, a negative phase input terminal and an output terminal, wherein the positive phase input terminal is configured for receiving the complex lamp current signal, the negative phase input terminal is configured for receiving a lamp current signal, and the negative phase input terminal is connected to the output terminal;

a pulse width modulation (PWM) signal generator connected to the output terminal of the operational amplifier and configured for generating a pulse width modulation signal; and a driver connected to the pulse width modulation signal generator and configured for generating the control signal according to the pulse width modulation signal.

11. The discharge lamp system as claimed in claim 1, wherein the converter is a DC/DC converter.

12. The discharge lamp system as claimed in claim 11, wherein the DC/DC converter is buck converter.

13. The discharge lamp system as claimed in claim 12, wherein the buck converter comprises:

a switch having a first end, a second end and a control end, wherein the first end is connected to the power supply device, the second end is connected to the discharge lamp, and the control end is connected to the driver and configured for switching on or switching off the switch according to the control signal.

14. The discharge lamp system as claimed in claim 13, wherein the switch is switched on or switched off according to the control signal to control an output current.

15. A method for controlling a discharge lamp, the method comprising:

(a) providing a synchronization signal and at least one lamp state signal, wherein the lamp state signal is a signal corresponding to a lamp voltage, a lamp current or a lamp power of the discharge lamp;

(b) generating an average lamp current signal and a pulse current signal according to the synchronization signal and the lamp state signal;

(c) generating a control signal according to the average lamp current signal and the pulse current signal, wherein the operation (c) further comprises:

adding the average lamp current signal to the pulse current signal to generate a complex lamp current signal;

comparing the complex lamp current signal with a lamp current signal to obtain a comparison signal;

modulating pulse widths of the comparison signal to obtain a pulse width modulation signal; and amplifying the pulse width modulation signal to obtain the control signal; and (d) performing current control of the discharge lamp according to the control signal.

16. The method as claimed in claim 15, wherein the lamp state signal comprises a lamp voltage signal and a lamp current signal.

* * * * *